US009080564B2

(12) United States Patent
Drevet

(10) Patent No.: US 9,080,564 B2
(45) Date of Patent: Jul. 14, 2015

(54) DIAPHRAGM CIRCULATOR

(71) Applicant: AMS R&D SAS, Venette (FR)

(72) Inventor: Jean Baptiste Drevet, Paris (FR)

(73) Assignee: AMS R&D SAS, Venette (FR)

( * ) Notice: Subject to any disclaimer, the term of this patent is extended or adjusted under 35 U.S.C. 154(b) by 0 days.

(21) Appl. No.: 13/679,290

(22) Filed: Nov. 16, 2012

(65) Prior Publication Data

US 2013/0078122 A1 Mar. 28, 2013

Related U.S. Application Data

(60) Division of application No. 12/156,249, filed on May 30, 2008, now abandoned, and a continuation of application No. PCT/FR2006/002596, filed on Nov. 28, 2006.

(30) Foreign Application Priority Data

Nov. 30, 2005 (FR) ..... 05 12182

(51) Int. Cl.
*F04B 17/00* (2006.01)
*F04B 43/02* (2006.01)
*F04B 43/00* (2006.01)

(52) U.S. Cl.
CPC ..... *F04B 43/02* (2013.01); *F04B 43/0018* (2013.01); *F04B 43/0054* (2013.01)

(58) Field of Classification Search
CPC .... F04B 43/026; F04B 45/024; F04B 45/043; F04B 43/0018; F04B 43/02; F04B 43/0054
USPC ..... 417/413.2, 478, 413.1, 472, 436, 423.1, 417/244, 255, 395, 415–417, 267, 268; 92/96, 98 R; 415/90; 310/12.31, 14; 335/262, 279; 181/166–170, 173–174
See application file for complete search history.

(56) References Cited

U.S. PATENT DOCUMENTS 2,093,295 A * 9/1937 Teeter ..... 417/248
2,240,371 A * 4/1941 Linch et al. ..... 92/13.2

(Continued)

FOREIGN PATENT DOCUMENTS

EP 0020245 11/1980
EP 0412856 2/1991

(Continued)

OTHER PUBLICATIONS

Machine translation of French Patent FR 2905147 A1 to Voogsgerd et al.*

*Primary Examiner* — Peter J Bertheaud
*Assistant Examiner* — Dnyanesh Kasture
(74) *Attorney, Agent, or Firm* — Muncy, Geissler, Olds & Lowe, P.C.

(57) ABSTRACT

A diaphragm circulator for liquid material including a body defining a plurality of propulsion chambers with rigid walls and including a plurality of deformable diaphragms with the chambers being connected in series. In each chamber, between the rigid walls of the chamber, is placed one of the diaphragms with an edge adjacent to an inlet port of the chamber and an edge adjacent to an outlet port of the chamber. A diaphragm-exciting member is arranged to cooperate with the diaphragms in order to generate ripples along the diaphragms. In each diaphragm, at least when the diaphragm ripples, a tension is generated in the diaphragm so that the diaphragm tension on the side of the discharge orifice is greater than on the side of the intake orifice.

13 Claims, 6 Drawing Sheets

(56) References Cited

U.S. PATENT DOCUMENTS

| | | | | |
|---|---|---|---|---|
| 2,888,877 | A | 6/1959 | Shellman et al. | |
| 2,998,552 | A * | 8/1961 | Ray | 335/247 |
| 4,565,501 | A * | 1/1986 | Laurendeau et al. | 417/267 |
| 5,463,263 | A * | 10/1995 | Flynn | 310/181 |
| 6,626,727 | B2 * | 9/2003 | Balanchi | 446/85 |
| 6,732,385 | B1 * | 5/2004 | Henderson et al. | 4/295 |
| 6,796,215 | B1 * | 9/2004 | Hauser et al. | 92/80 |
| 2001/0001278 | A1 | 5/2001 | Drevet | |

FOREIGN PATENT DOCUMENTS

| | | | | |
|---|---|---|---|---|
| EP | 0880650 | | 12/1998 | |
| FR | 2905147 | A1 * | 2/2008 | F04B 43/04 |
| WO | WO 2005/119062 | | 12/2005 | |
| WO | PCT/FR2006/002596 | | 6/2007 | |

* cited by examiner

DIAPHRAGM CIRCULATOR

This patent application is a divisional of U.S. patent application Ser. No. 12/156,249, filed on May 30, 2008, which is a continuation of International Application PCT/FR2006/002596, with an international filing date of Nov. 28, 2006, now abandoned.

BACKGROUND OF THE INVENTION (1) Technical Field

This invention relates to a diaphragm circulator and, more generally, to a device whereby mechanical power is converted into hydraulic power, i.e., the product of the flow rate multiplied by the pressure, for a liquid or gaseous fluid charged or uncharged with particles, or for any material capable of flowing (divided, powdery, fluidized or emulsified materials).

(2) Description of the Prior Art

There are numerous types of pumps, suction devices, compressors, fans . . . which perform this function. A new technique has recently appeared for providing this function, at least for a liquid, by means of a diaphragm acting as an intermediate means of converting (a transfer medium) mechanical power (the integral over a time interval of the product of force multiplied by displacement) into hydraulic power (the integral over the same interval of the product of flow rate multiplied by pressure), this transfer occurring by way of a deformation and kinetic energy of this diaphragm, the deformation being propagated in the diaphragm in the form of a ripple and the corresponding energy being progressively transferred to the fluid with which the diaphragm is in contact.

The document EP 880 650 exemplifies several embodiments of such a fluid circulator while emphasizing certain requirements to be met for there to be an efficient transfer of energy between the diaphragm and the fluid, resulting in an increase in the hydraulic power of the fluid. These requirements are the establishment of tension in the diaphragm in order for there to be ripple propagation, on the one hand, and, on the other hand, the presence of means of creating a damping of the ripple amplitude during the progression thereof from an edge of the diaphragm, where this ripple is generated by a mechanical actuator, up to an opposing edge.

This document teaches the use of rigid walls as damping-creating means, the spacing of which decreases from the inlet port to the exhaust port for the fluid treated by the circulator.

Many studies have been conducted on this new device in order to better characterize the phenomena involved, which had never before been explored, and to optimize the parameters which govern these phenomena. In particular, these studies made it possible to better identify the requirements to be met, which are stated to a limited extent in the document EP 880 650, which furthermore is the only element exemplifying the prior art for this new technique.

This is how experiments showed that the tension state of the diaphragm is a variable which is correlated with the mechanical properties of the material of this diaphragm. In reality, the initial tension state of the idle diaphragm can be equal to zero if, for example, the diaphragm is made of a material which is elastically deformable in at least one direction, combined with a geometry such that imposing a deformation on the diaphragm produces tension therein, in the aforesaid direction, which enables progression of this deformation in the form of a ripple, along this direction, which becomes the direction of propagation. Hereinafter, this type of diaphragm will be referred to as a diaphragm having intrinsic tension-creating means. For example, this will involve an elastic disk-shaped diaphragm, with or without an opening at the centre, wherein the outer edge remains undeformed during the excitation thereof by the actuator, while the idle diaphragm is not tensed. It may likewise involve a flat elastic diaphragm wherein the two ends are subjected to forces which oppose the forces imparted to the diaphragm by the fluid in which the energy is transferred. Owing to the presence of these forces, the conditions necessary for the propagation of a deformation produced at one end towards the other end are present.

It was also observed that a diaphragm consisting of a sheet which is flat when idle, non-deformable under tension, in the directions of the plane thereof, but elastically deformable under bending, e.g., about an axis contained within this plane, constitutes a medium enabling operation like a diaphragm according to the invention, if the diaphragm is subjected to a tensile or simply holding force perpendicular to or having a component which is perpendicular to the axis about which the bending occurs. This perpendicular direction is the direction of propagation.

Furthermore, theoretical and experimental research made it possible to clarify that it was possible to create a forced damping of the ripple amplitude without necessarily having to decrease the spacing of the stationary walls between which the diaphragm ripples. As a matter of fact, an excitation of the actuator resulting in the application of an reciprocating force or an reciprocating couple of given frequency and amplitude forces, at an edge of the elastic diaphragm placed inside the fluid, in the absence of walls surrounding it, generates ripples capable of propagating along the diaphragm towards the side thereof which is opposite the excited side, with a free amplitude which may be characterized by envelope surfaces of this amplitude. In order to visualize these envelope surfaces, a reflectionless propagation of waves or ripples considered, i.e., in the (theoretical or virtual) case where the diaphragm is of infinite length or the evolution of the amplitude of a primary ripple between a first instant, after the creation thereof, and a second instant separated from the first by a relatively short time interval, considering the dimensions of the diaphragm. The shape of these surfaces depends on the nature of the excitation of the diaphragm edge. Thus, in the case of excitation by means of an actuator which moves the edge of the diaphragm, the envelope surfaces will have a divergent bell-shaped profile; in the case of an actuator transmitting a couple of forces to the edge of the diaphragm, the surfaces will instead have the profile of two curves secant to the axis about which the torque is transmitted. Force damping of this ripple is obtained if stationary walls between which the diaphragm ripples are placed between (inside of) these envelope surfaces.

This condition does not necessarily eliminate a decrease in their spacing, as is described in the document EP 880 650. For particular diaphragm geometries and types, and particularly in a gaseous fluid, it is indeed possible to observe that the envelope curves diverge between the excited edge and the opposite edge of the diaphragm, thus, by simply reducing the degree of divergence, hydraulic power is successfully transferred into the fluid. The greater this reduction, the greater the preference given to the pressure component in this energy. The type of material comprising the diaphragm as well as the uniformity thereof, or the lack of uniformity thereof, in the direction of progression of the ripples, are also determining factors in the shape of the envelope surfaces of the amplitude of a ripple during the propagation thereof into the diaphragm, and are therefore determining factors in the shape and relative spacing of the rigid walls which create the forced damping of this ripple. In particular, for a uniform diaphragm, it is advantageous to provide for the thickness thereof to decrease in the direction of propagation of the ripples. The envelope curve of a tapered diaphragm such as this is more divergent than for a diaphragm of constant thickness, all things being otherwise equal. Due to this diaphragm geometry, a high damping factor is obtained, since stationary walls can be well within these envelope curves.

SUMMARY OF THE INVENTION

These observations and experimental research enabled the subject matter of the invention to be defined as a diaphragm circulator for a flowable material, comprising a circulator body wherein an internal circuit is arranged, which has at least one inlet port for the material, one propulsion chamber and at least one discharge port for this material, the propulsion chamber having rigid walls between which a deformable diaphragm is placed, with one edge adjacent to the inlet port and one edge adjacent to the discharge port, the diaphragm forming the support for a ripple, while a mechanical actuator for the diaphragm is connected to the diaphragm on the inlet port side, in order to apply an reciprocating force or a couple of reciprocating forces generating said ripple to the corresponding edge of the diaphragm, wherein the rigid walls of the circulator are arranged inside of envelope surfaces of the free amplitude of the ripple propagating along the diaphragm, and wherein the diaphragm is associated, via at least one of the edges thereof, with means which create tension in the diaphragm, at least during generation of the ripple, whereby, during operation, the prevailing tension in the diaphragm is higher on the discharge port side than on the inlet port side.

This variation in tension in the diaphragm is a result of the trussing effect on the diaphragm by the fluid having acquired hydraulic energy along the entire propulsion chamber.

In the above definition of the circulator according to the invention, the free amplitude of the ripple should be understood to mean the theoretical or virtual amplitude that was defined above. This definition is neither disclosed nor suggested by the circulators of the prior art (EP 880 650), i.e., those which have both a circulation chamber the walls of which converge towards one another from the inlet port to the discharge port, and a diaphragm in which tension is voluntarily established in the direction of the fluid flow. However, this definition relates to all circulators which, while having a circulation chamber with converging walls, also have a diaphragm the dimension of which, in the direction of ripple propagation, is set by appropriate means so that in the diaphragm, even without any initial tension, the elongation of the diaphragm which accompanies the creation of a ripple generates tension in the direction of ripple propagation, the diaphragm being made or not made of a material that is elastically deformable in the direction of propagation. These are intrinsic means of establishing this tension condition necessary for propagation. Other examples of this type of means exist: a frame in the interior plane of which the diaphragm is attached to the end crossmembers of this frame, either by inextensible means, if the diaphragm is elastic between these two crossmembers, or by extensible means, if the diaphragm is inextensible between the crossmembers (e.g., a flat sheet, made of metal or a composite synthetic material, capable of bending about a direction of the plane thereof). An initial tension may or may not be established when the diaphragm is mounted in the frame. These arrangements can be transposed in the case of tubular diaphragms provided with elastic radial extensibility.

In the case of a disk-shaped diaphragm, this requirement is met if the peripheral edge of the diaphragm is integral with a non-deforming band, the diaphragm having the possibility of being solid or perforated at the centre thereof with an opening the edge of which is a means of immobilizing the diaphragm truss in the direction of ripple propagation. The dimensional characteristic of the diaphragm would not be achieved if, for example, the edge of the centre hole thereof were provided with radial incisions, which would destroy the expansion resistance of the opening.

The non-deforming outer banding of the diaphragm can consist of a bead belonging to the diaphragm itself, which is non-deforming with respect to the loads involved, which may be light.

The term "rigid walls" should also be understood to mean walls which, in absolute terms, may however possess a certain degree of flexibility, but which, when applied to use, behave like rigid walls with regard to all of the other materials involved in the device.

In a first embodiment of the invention, a portion of the propulsion chamber is defined by the circulator body and one of the faces of the diaphragm is connected to an inlet port for an external supply of a material being treated, and, in particular, propelled, and to a discharge port which is itself connected to the inlet port of the other portion of the propulsion chamber defined by the circulator body and the other face of the diaphragm, this other portion terminating at the circulator discharge port, the two chamber portions being otherwise separated from one another.

In this embodiment, a circulation stage is created on each side of the diaphragm, which, all things otherwise being equal, makes it possible to obtain a greater pump pressure performance or, at equal performance, to be capable of choosing a diaphragm material which has a lower modulus of elasticity but which is better suited to the chemical specifications of the application. In particular, this increased performance can be obtained with the over dimensions being unchanged. In another embodiment, the circulator comprises a disk-shaped diaphragm the outer periphery of which is attached to a moving excitation assembly which is guided along an axis perpendicular to the plane of the diaphragm by a centre guide column integral with the circulator body. This type of excitation device is advantageous because it concentrates all of the motorizing and guiding functions at the central axis of the circulator, functions which can be provided at reduced dimensions, which enables them to be obtained at a low cost. The motorization and guidance of the moving parts are in fact the most costly functions of the circulator. For example, it is easy to motorize by means of a plunger core electromagnet with a return spring, the core, which slides along the guide column, being attached to a stirrup clamp for the connection thereof to the periphery of the diaphragm, thereby forming the moving assembly.

In a yet simpler embodiment, the moving assembly comprises an annular permanent magnet surrounding the guide column, which forms the plunger core for a magnet coil and armature arranged around the permanent magnet.

The circulator according to the invention can have a substantially cylindrical body which defines several superimposed propulsion spaces connected in series between an inlet port and a discharge port, the diaphragms of each space being attached via the outer edge thereof to a single moving motorization assembly. In this way, a circulator is obtained with compact design, which is capable of supplying a fluid under high pressure.

For another application of the invention, a structure will have been provided wherein the outer edge of the diaphragm (or of the support thereof) is provided with exterior relief surfaces which constitute shearing members for the surrounding product being treated. In order to increase the efficiency of this shearing, which turns into grinding, the moving assembly and the diaphragm are driven in a complementary continuous or reciprocating rotational movement about the aforesaid guide axis.

For the purpose of providing a silent circulator, the latter comprises a vibration generator for generating vibration in the circulator body which is opposite in phase to the reciprocating movement of the moving assembly. As a matter of fact, the movement of the moving assembly is substantially reciprocal, linear and at a controlled frequency. This characteristic lends itself well to the creation of active sound insulation. The vibrator can be of any electromagnetic or piezoelectric type.

In another embodiment, the diaphragm is of a quadrilateral shape with two parallel opposing sides, and the ripple generator is a variable reciprocating force couple.

This arranged is particularly well-suited to relatively light diaphragms of low surface density, which are intended to propel a gas like a fan. As a matter of fact, in this application, it is useful to assign greater importance to the flow rate in comparison to the pressure, and to thus produce and propagate a ripple of considerable amplitude. The edge of the diaphragm opposite the excited one is subject a hold which opposes both variation in the length thereof, as a result of the ripple effect, and trussing of the diaphragm due to the action of the fluid.

Numerous applications of the air circulator are possible. Mention is made in particular of household appliances such as hand dryers or hair dryers which will have a have a completely novel shape in comparison with that of existing appliances, which is dictated by the rotating shape of an air-blowing turbine.

Mention should also be made of one advantageous application of this circulator for cooling electronic components and boards. As a matter of fact, these latter are increasingly more powerfully, compact as a result of the miniaturization thereof, and built into any computer, such as a portable or non-portable personal computer, or a computer on-board a vehicle. In this application, at least one of the walls of the circulation chamber forms a radiator for the component being cooled. It is thus swept by the air propelled into this chamber. It may likewise be textured with relief surfaces, small-size fins or ribs which increase the transfer surface.

Finally, among the numerous other applications of the circulator of the invention, mention will be made of those wherein it comprises a propulsion unit for a means of transport, a watercraft in particular (buoyant or submarine), the circulator being rigidly attached via the body thereof to the craft, while the fluid which passes through the circulation chamber and receives the diaphragm's energy, generates a reaction force which propels the craft.

Other characteristics and advantages of the invention will emerge from the description provided below of several exemplary embodiments of the circulator.

DESCRIPTION OF THE DRAWINGS

Reference will be made to the appended drawings, in which.

DETAILED DESCRIPTION OF THE PREFERRED EMBODIMENT

Figure 1:
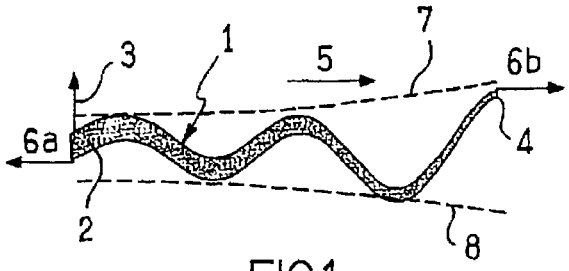
FIG. 1 is a diagram showing a diaphragm according to the invention and the envelop curves for the free propagation of a reflectionless ripple maintained along one of the edges thereof.

A sectional view of a diaphragm 1 has been shown in FIG. 1, having one end (or one edge) 2 subjected to a reciprocating mechanical excitation force 3 of this end 2, which is perpendicular to the plane of the diaphragm, and which is generated by an electromechanical actuator. The diaphragm comprises another edge 4, with the result being that a direction of propagation 5 is defined between the two edges, for the ripples produced by the reciprocating mechanical force 3.

The edges 2 and 4 of the diaphragm may be rectilinear or concentrically circular. Mention will also be made of tubular-shaped diaphragms each of the edges of which are at one end of a tube.

Tension in the existing diaphragm in its resting state or resulting from a resistance to its elongation under the effect of this mechanical stress is represented by the forces 6*a* and 6*b*. This diaphragm, now extended, is the source of propagation of the wave in the direction of the tension.

Assuming that edge 4 is infinite, with a diaphragm of decreasing thickness in the direction 5 of the propagation and/or in the absence of reflection of the ripple, the theoretical free amplitude of the ripple increases from edge 2 to edge 4. The amplitude is contained between the two ripple envelope surfaces shown in FIG. 1, referenced as 7 and 8.

Figure 2A:
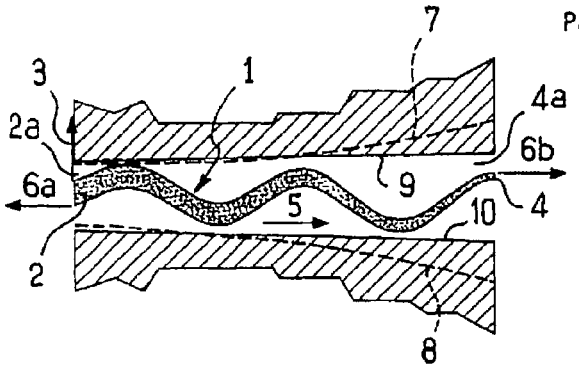
FIG. 2A shows the notion of forced damping of a diaphragm consistent with the one shown in FIG. 1, assigning greater importance to the flow rate in hydraulic power.
Figure 2B:
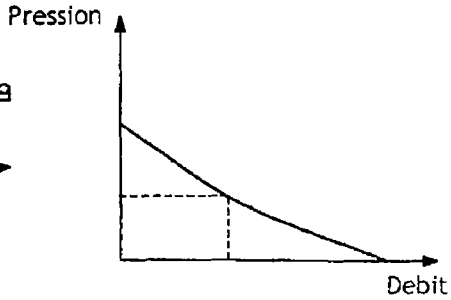
FIG. 2B shows the appearance of the corresponding flow rate/pressure curve.
Figure 3A:
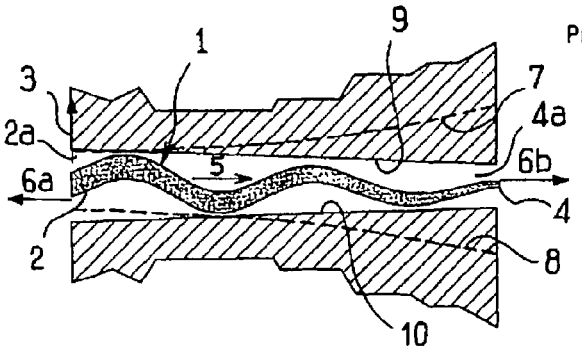
FIG. 3A shows the notion of forced damping of a diaphragm consistent with the one shown in FIG. 1, assigning greater important to pressure in hydraulic power.
Figure 3B:
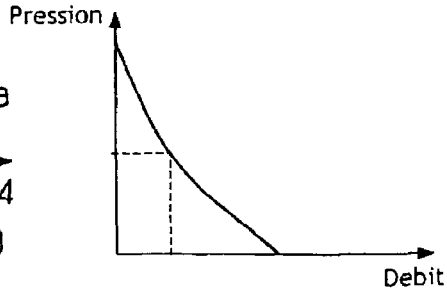
FIG. 3B shows the appearance of the corresponding flow rate/pressure curve.

Now, as shown in FIG. 2A, if the amplitude of the diaphragm ripple which propagates between edges 2 and 4 is constrained to lower values than in the free state, by rigid surfaces 9 and 10, which are situated inside of the envelope curves 7 and 8, energy transfer occurs between the diaphragm and the fluid, which results in an increase in the hydraulic energy of the fluid, as represented by the curve of FIG. 1B, showing pressure as a function of flow rate. This energy is transferred over the course of travel of the fluid between an inlet port 2*a* and a discharge port 4*a* of the spaced confined between the walls. In the case of the arrangement of the surfaces of FIG. 2A, the system assigns greater importance to the flow rate component in the energy transferred to the fluid, as shown in the graph of FIG. 2B. This does not involve a volumetric transfer of fluid, as the figure might allow one to assume. In general, a clearance exists between the peaks of the ripples and surfaces 9 and 10. However, it may possibly be desired to establish contact between each peak of the ripple and the stationary walls. In this case, the surface nature of the walls will depend on the role of the contacts to be made (e.g., to create particular fluid flows in the propulsion chamber). The deformation and kinetic energy of the diaphragm placed inside the circulation space defined by surfaces 9 and 10 is communicated to the fluid, because the amplitude of the ripple is constrained to a value lower than the free value thereof. This reduction in the amplitude is accompanied by a variation in the wave length, and enables energy transfer between the diaphragm and the fluid. When, for example, walls 9 and 10 are more convergent, as in FIG. 3A, it is the pressure component that is dominant in the energy transferred, as shown in the graph of FIG. 3B.

It should be noted that, during operation, a sort of trussing of the diaphragm occurs, in the direction of the fluid inlet end, the intensity of which is proportionally greater the higher the hydraulic energy acquired by the fluid. The result of this is a variation in the tensile forces of the diaphragm along the direction of propagation, the highest force 6*b* being observed at the end 4 of the diaphragm 1, adjacent to the discharge port 4*a* of the propulsion chamber. Thus, tension in the diaphragm is not constant and, for a uniform diaphragm, one of the consequences of this variation is the extension of the length of the ripple between the inlet port and the discharge port. Under the same conditions, fluid velocity inside the circulation chamber increases from the inlet port 2*a* to the discharge port 4*a* of the circulation chamber.

Edge 2 of the diaphragm 1 can be attached to a reciprocating force couple generator, no longer imparting a reciprocating linear movement to this diaphragm, as in the example shown, but a reciprocating angular movement. In the same way, this stressing of the diaphragm generates a ripple due to the fact that the diaphragm is subjected to the same intrinsic or extrinsic tension conditions.

Figure 4A:
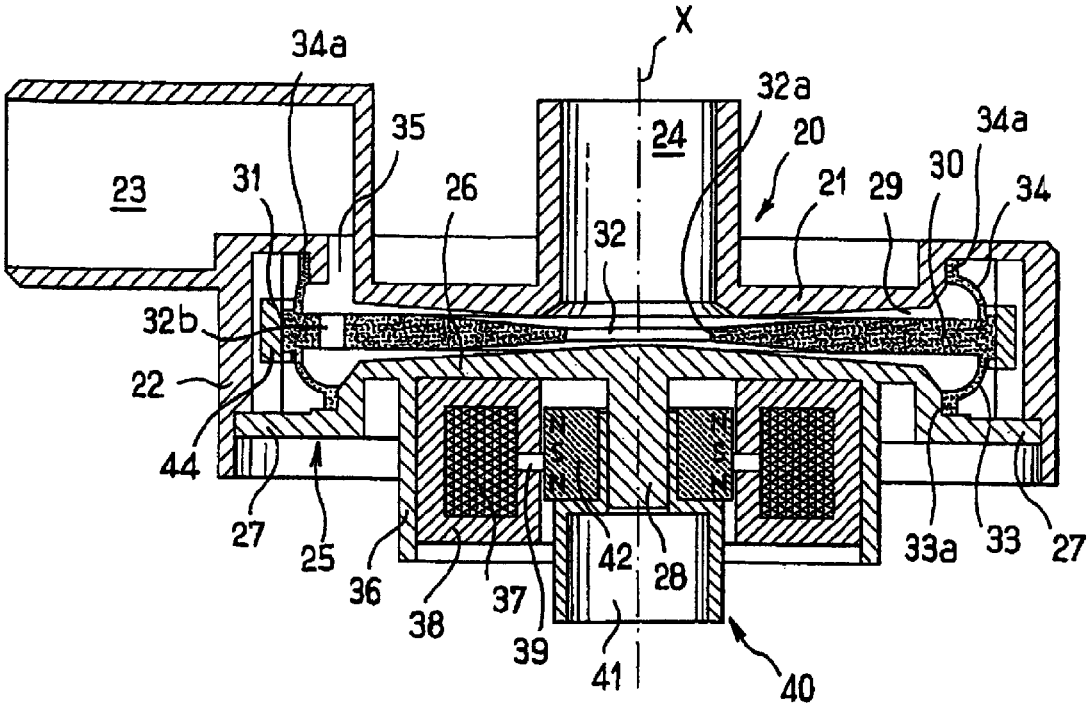
FIGS. 4A and 4B are two orthogonal sectional views passing through a central axis of a pump geometry implementing the circulator according to the invention, FIGS. 5A and 5B sectional diagrams showing two alternative embodiments of a diaphragm pump with two propulsion stages.
Figure 4B:
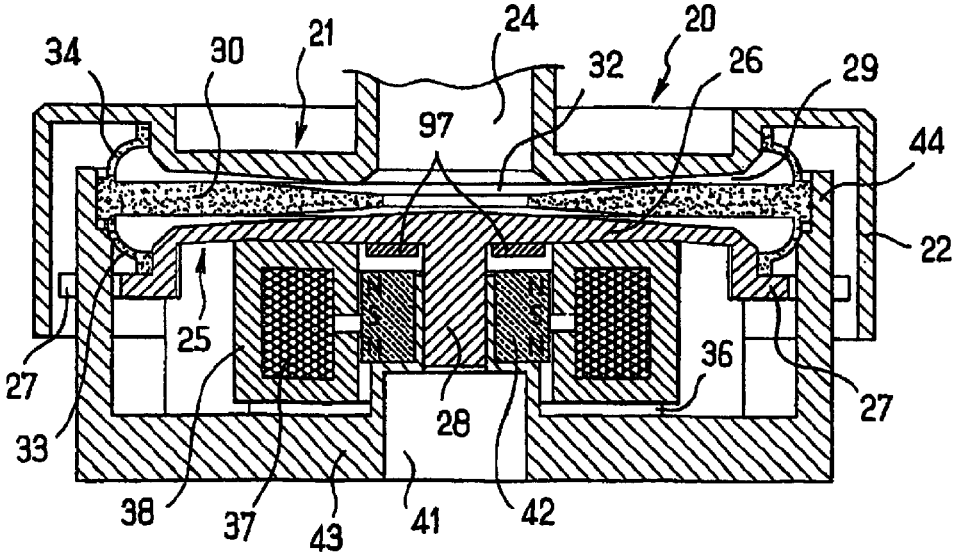

FIGS. 4A and 4B show an embodiment of the invention in the form of a disk-shaped diaphragm pump. The body of this circulator or of this pump consists of two parts. A first part 20 takes on the overall shape of a cup with a bottom 21 and a side skirt 22, the bottom 21 comprising one of the rigid walls of the propulsion chamber. This part 20 is provided with two end fittings 23 and 24, end fitting 23 forming the inlet port of the circulator and terminating at the periphery of the bottom 21, while end fitting 24 is a discharge fitting for the circulator, situated on the central axis X of symmetry of part 20 of the circulator body.

Part or cup 20 receives the second part 25 of the circulator body, which closes up the skirt 22 opening, this second part 25 comprising a stationary wall 26 which is placed opposite wall 21 of the first part 20, in order to define the fluid propulsion chamber, this part having radial extensions 27 whereby it cooperates with the first part 20 inside of the skirt 22, in order to establish the relative position and spacing of the two walls 21 and 26 surrounding the propulsion chamber. The connection between the two parts 20 and 25 is ensured by any known means (clamping, gluing, screwing, welding . . . ). In the axis of symmetry of the circulator, part 25 also comprises a centre column 28 opposite the end fitting 24, which forms the guide element for a moving assembly described hereinbelow.

The propulsion chamber 29 contains an elastically deformable diaphragm 30 between walls 21 and 26. This diaphragm 30, which is disk-shaped, has a peripheral bead and a central opening 32 bounded by an edge 32*a*. Through openings 32*b* are made in the diaphragm in order to distribute the fluid taken in on both sides of the diaphragm. The peripheral bead 31 comprises the base of two flexible lips 33 and 34 having a partially tonic shape, the free edge of which is provided with cylindrical beads 33*a*, 34*a* which close up the chamber sealingly at the outer periphery of the stationary walls 21 26. In the vicinity end fitting 23, the connection of lip 34 with part 20 of the circulator body leaves an influent conduit 23 open, which permanently connects the propulsion chamber 29 space contained between the rigid walls 21 and 26 to the interior space of the inlet end fitting 23, thereby forming an annular distribution chamber for the intake into the propulsion chamber.

The second part 25 of the circulator body comprises a cylindrical wall 36 surrounding the column 28, which forms the housing for an electromagnetic device comprising a coil 37, the axis of which is the axis of revolution of the circulator, and an armature 38 with an air gap 39. At the air-gap terminals 39, the armature thus defines two poles which are reversed at each reversal of the electrical current flowing inside the winding 37. The armature can be made of pure iron or of an iron-silicon, powder-based composite material in a resin matrix (known commercially under the trademark SOMALLOY), or consist of a laminated structure.

Finally, the circulator described comprises a stirrup 40 with a central core 41 slidably mounted on the column 28 and provided with a magnetized ring 42, which is plumb over the air gap 39, so as to have three superimposed cylindrical pole surfaces references as MSN in the figures. It is pointed out that this type of magnetized ring can be of the plasto-magnet type, i.e., a finely divided magnetic material (ferrite, rare earth, samarium, iron or cobalt powder . . . ) in a plastic matrix that has been magnetized during manufacture while controlling the direction of magnetization. The magnet can be designed as an assembly of permanent magnets and suitable armatures.

Starting in a radial direction from the core 41, the moving assembly comprises arms 43 which connect it beneath the skirt 36 to the bead 31 of the diaphragm 30. These arms are visible in FIG. 4B, while FIG. 4A is a sectional view which is orthogonal to the preceding one and which passes through the axis of revolution of the circulator. It is noted that the arms 43 tightly encircle the bead 31 by means of a rigid ring 44 visible in FIG. 4A. The arms 43 pass between the lugs 27 of the second portion 25 of the circulator body. It is noted that, in FIG. 4B, the cutting plane passes through two slots in the skirt 36, slots in which the arms 43 can move about freely.

It is observed that the pump in these FIGS. 4A and 4B is of an extremely simple construction. As a matter of fact, it comprises at a maximum eight parts, namely a two-part body, a diaphragm, a stirrup, a permanent magnet, a two-part armature, as shown in FIG. 4A, and a winding. It is also noted that, in this architecture, the most costly components, which are the permanent magnet, the winding and the armature thereof, are of the smallest possible dimensions, in order to obtain the lowest cost. The other parts are non-magnetic parts, and preferably made of a plastic material, the diaphragm being made of elastomer or silicon, or of any suitable synthetic material, the cost price of which is extremely low. In this way, therefore, the architecture proposed in these figures enables obtainment of a very inexpensive pump or circulator.

Figure 5A:
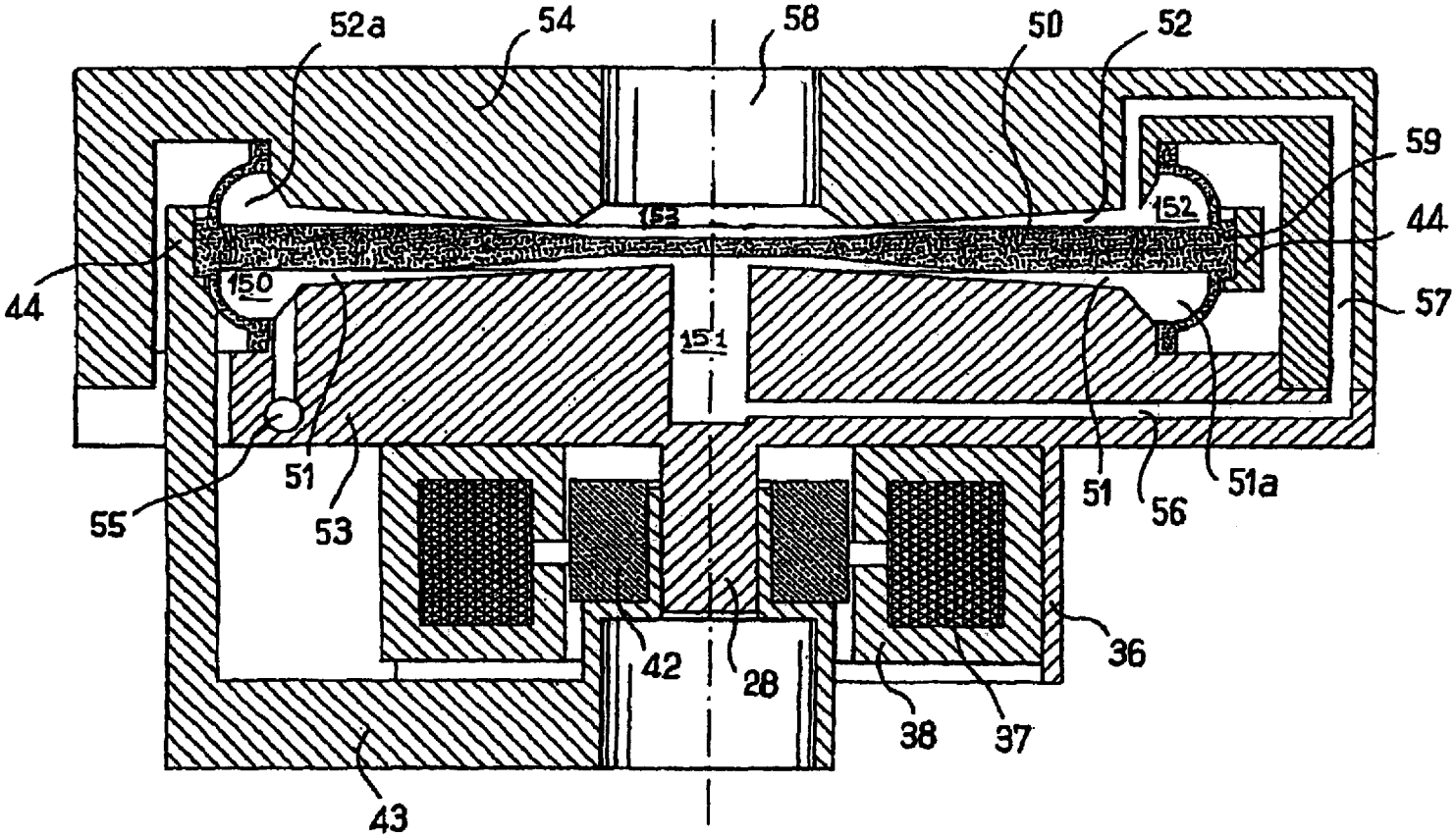

The embodiment shown in FIG. 5A is schematic and comprises left-hand half view, produced in a cutting plane similar to that of FIG. 4B, while the right-hand half view is similar to the cutting plane of FIG. 4A. In this embodiment, the driving part of the circulator is identical to the one described previously and the same elements bear the same reference signs. This circulator comprises a diaphragm 50 devoid of a central opening, which thus divides the propulsion chamber defined by the two parts of the circulator body into two parts 51 and 52. The two parts 53 and 54 of the circulator body are such that the lower part 53 comprises an influent conduit 55 discharging into the annular chamber 51*a* for distributing the product intake into part 51 of the propulsion chamber, the exhaust of this part 51 of the propulsion chamber being connected to a conduit 56 also arranged here in part 53 of the body, while part 54 of the circulator body comprises a conduit 57 which hooks up with conduit 56 in order to convey the product from the exhaust of chamber part 51 to the peripheral distribution chamber 52*a* for the intake of chamber part 52. Chamber part 52 has an exhaust port 58 in body part 54. Conduit 55 is connected in a manner not shown to a fluid source, while opening 58 has means for the connection thereof, likewise not shown, to a discharge line for the pressurized fluid.

In this embodiment, it is understood that the fluid admitted into chamber part 51 via conduit 55 is placed into circulation and undergoes a first pressure rise in the propulsion chamber part 52. Thus, a double pressure rise occurs for a single fluid flow rate. As in the preceding embodiment, the a.c. power supply of the winding 37 results in a reciprocating movement of the stirrup 40 and thus a reciprocating excitation of the outer edge 59 of the diaphragm 50, perpendicular to the mid-plane thereof. In this embodiment, as in the preceding embodiment, the number of constituent parts of the pump or circulator is very low, hence a very inexpensive cost price. Furthermore, all things otherwise being equal from a dimensional standpoint, this embodiment makes it possible to obtain a higher discharge pressure for the treated fluid than that obtained with the preceding embodiment.

Figure 5B:
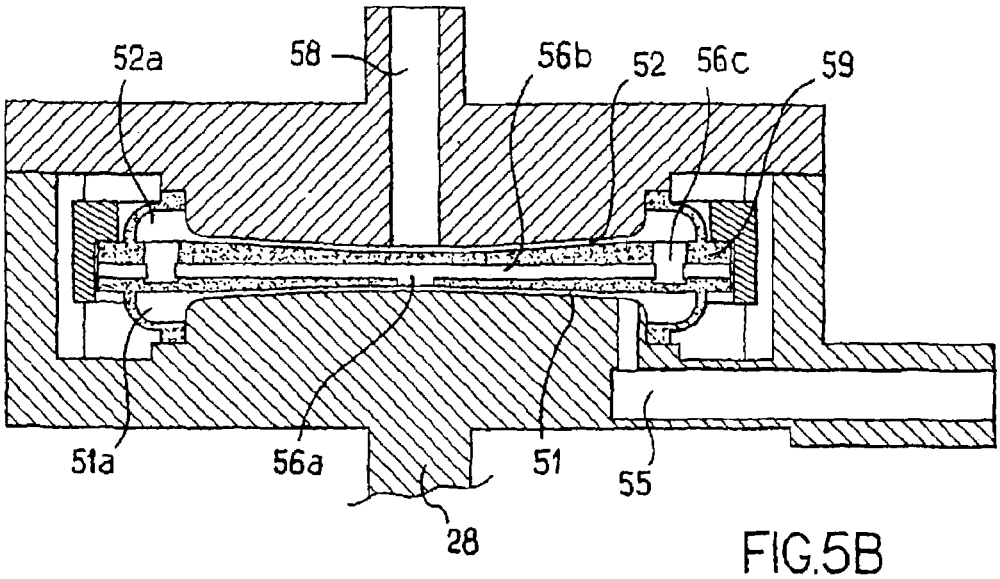

In FIG. 5B, an alternative to the embodiment of the preceding figure is shown. Communication between the exhaust of chamber part 51 and chamber part 52 is achieved via a conduit inside the diaphragm 50 and is referenced as 56*a*, 56*b* and 56*c*. Several star-connected radial conduits may exist within the thickness of the diaphragm. There may be an advantage in adopting this alternative embodiment, in terms of a range of circulators in which, for one dimension, it suffices to change the diaphragm in order to have a circulator with different characteristics. For easy production of this diaphragm with internal conduits, the possibility is mentioned of producing it in two parts. A first, disk-shaped part comprises a central through opening, and the other, which is also disk-shaped, is superimposed and comprises peripheral through openings and relief surfaces on the face thereof which faces the first diaphragm part, and which, together with the latter, defines radial conduits connecting the peripheral openings of the first part (inlet) to the central opening of the second part (exhaust), which are sandwiched between the two parts joined together by any appropriate means.

Figure 6:
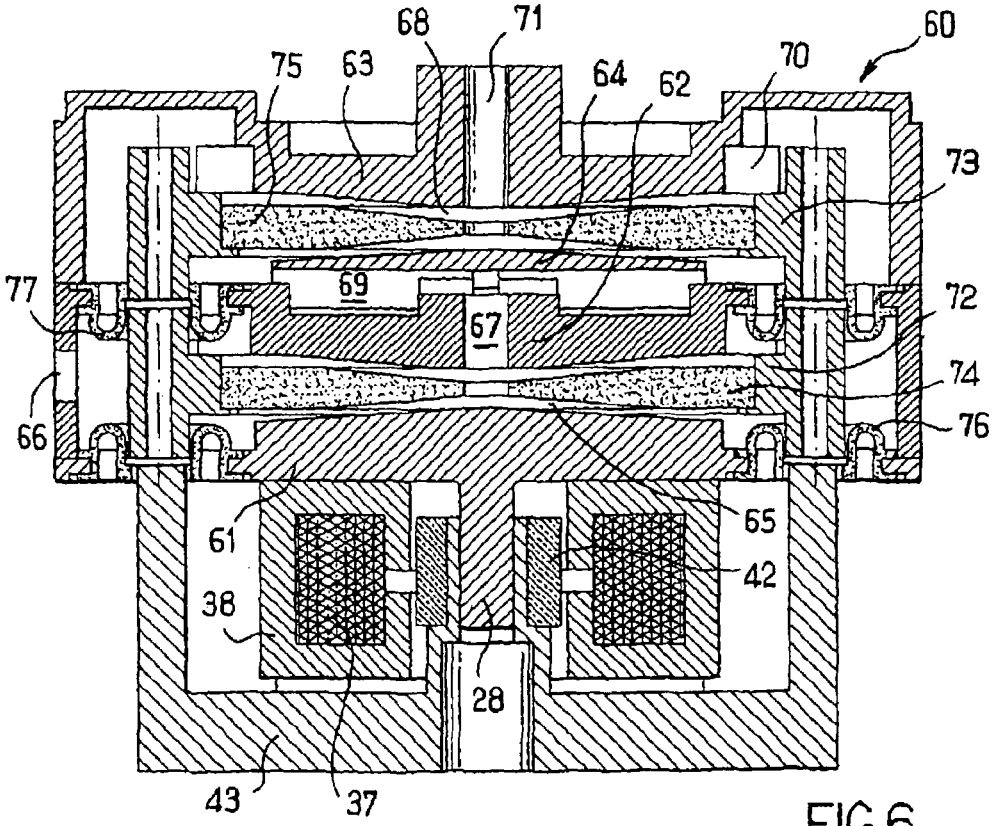
FIG. 6 is a sectional view of a circulator comprising several circulation chambers arranged in series on the fluid propulsion circuit.

FIG. 6 shows an embodiment of a circulator having two separate propulsion stages for the treated fluid, with two diaphragms. The two-stage circulator body 60 comprises three parts 61, 62, 63. Together, with part 62, part 61 defines the walls of a first propulsion chamber 65 the inlet port of which is referenced as 66. Part 62 has a central exhaust port 67 which terminates beneath a distributor 64 added on to part 62, this distributor 64 forming one of the rigid walls of the second propulsion chamber 68 also defined by the third part 63 of the circulator body. Via radial conduits 69, the distributor 64 makes it possible to convey the fluid coming from the exhaust port 67 into a second intake chamber 70 for the second propulsion chamber 68, which discharges into a general exhaust port 71. Parts 61, 62, 63 of the circulator body, as well as the distributor 64, are fastened to one another, for example, by gluing, welding or any other known means.

As in the preceding examples, part 61 of the circulator comprises a guide column 28 for a motor having the same elements as described previously, with the same reference signs. This is how, in the particular case of FIG. 6, the stirrup 43 is attached to two superimposed rigid crowns 72, 73 which are connected to the periphery of the diaphragms 74 and 75, respectively. The crowns 72 and 73 are capable of oscillating parallel to the direction of the geometric axis of revolution of the circulator, and they pass through the circulator body via means of flexible partitions 76 and 77, which separate the two stages of the circulator from one another.

It is understood that the fluid admitted at 66 is drawn into the propulsion chamber 65 by the rippling diaphragm 74, in order to be discharged through the exhaust port 67 and through the radial conduits 69 so as to reach the intake chamber 70 of the second propulsion stage for the fluid, and thereby be treated by oscillating diaphragm 75 and emerge from the circulator via the exhaust port 71.

The example shown in FIG. 6 is not limiting and it does not exceed the scope of the invention to anticipate other stages wherein the pressure of the same flow rate of fluid coming from the previous stages is once again raised in one or more additional propulsion chambers. It will of course be necessary to adapt the power of the driving element to the required performance levels for the circulator thus constructed.

Figure 7:
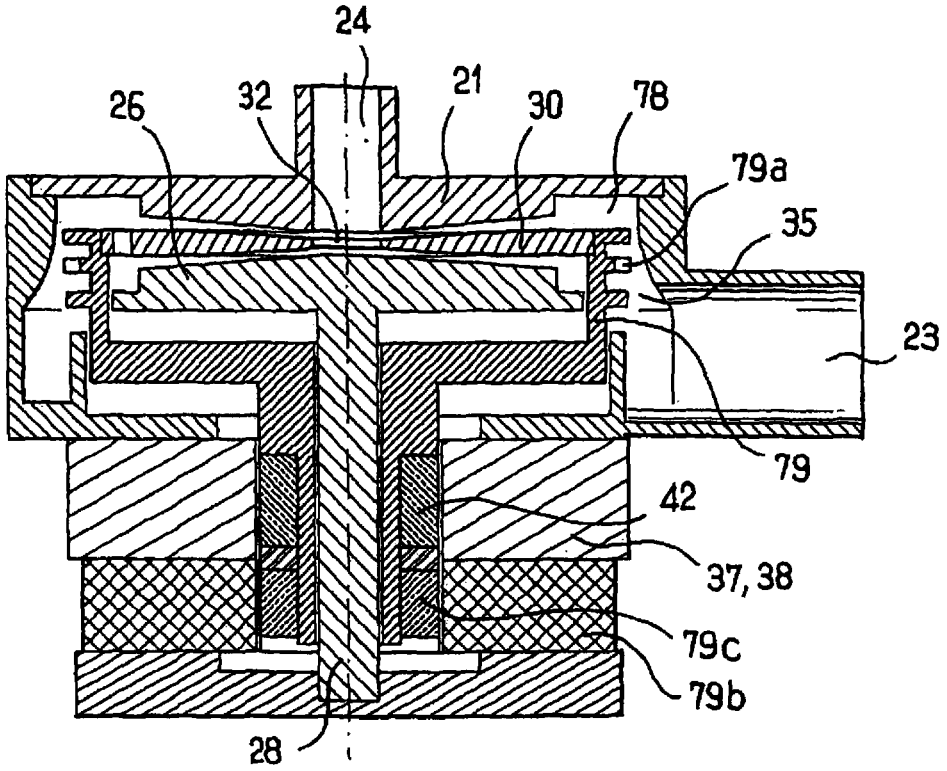
FIG. 7 is a schematic view of a circulator in accordance with the invention, applied to the treatment of effluents via pumping and communition.

An alternative embodiment of the circulator shown in FIGS. 4A and 4D is shown in FIG. 7. Some of the previously described elements are encountered here again with the same reference signs. In this case, the diaphragm is devoid of lips 33 and 34 and the annular distribution chamber 78 of the propulsion chamber is defined, around the periphery of the diaphragm 30, by a sleeve 79 integral with the periphery of the diaphragm 30 and with the driving assembly, which slides along the column 28 and forms a movable internal wall of the annular distribution chamber 78 for the intake of the propulsion chamber 29. This sleeve comprises relief surfaces 79*a* on the upper external face thereof facing chamber 78, which constitute means of grinding the contents of chamber 78, due to the reciprocating movement of same inside this chamber. The driving assembly can also comprise an electromagnetic means, consisting of a winding 79*b* and a permanent magnet core 79*c*, which imparts to the sleeve, the diaphragm and the relief surfaces a rotational movement around the column 28, thereby increasing the grinding efficiency. This rotation, which may be continuous, step-by-step, reciprocating . . . , is combined with the linear reciprocating movement of the sleeve along the column 28.

Figure 8:
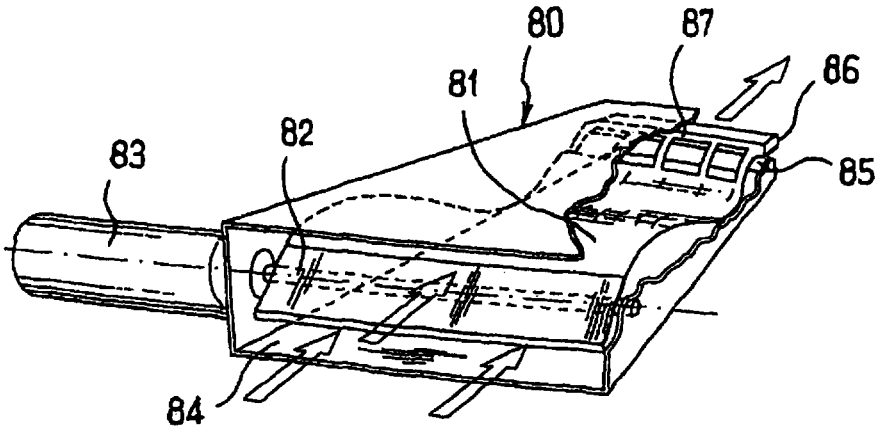
FIG. 8 is a schematic view of a ventilator in accordance with the invention.

A schematic representation of an air circulator 80 according to the invention is shown in FIG. 8. The diaphragm 81 used in this air circulator is rigidly attached via one of the end edges thereof to a vane 82 capable of being imparted with an oscillating rotational movement by means of a motor 83. The vane 82 thus applies a reciprocating force couple to the diaphragm, which enable an almost exclusively deforming energy to be introduced into the diaphragm. Here, the walls of the circulator 80 define a circulation chamber two sides of which converge from an inlet port 84 for the air being propelled to an exhaust port 85.

In this diagram, for example, a magnetostatic means for holding the diaphragm 81 is shown (a magnet 81 attracted by an armature 86), which forms the means necessary for establishing extrinsic tension in the diaphragm and resistant to the trussing tendency thereof.

A ventilator or air blower such as this is very advantageous because it comprises only very few constituent parts. Furthermore, as shown by experiments, it has a significant flow rate in comparison with the overall dimensions thereof. Its efficiency is advantageous because there are no internal head losses associated with a change in the direction of the airflow. Finally, the noise produced by this ventilator is incomparably lower than that observed with those on the market consisting, for example, of hair dryers and hand dryers, due, in particular, to a low operating frequency.

Figure 9:
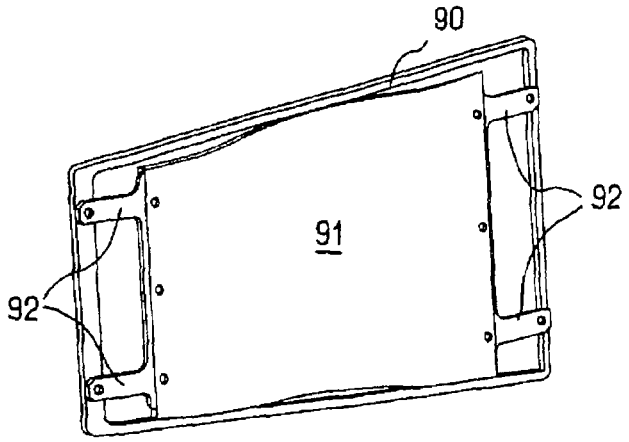
FIG. 9 shows an embodiment of a diaphragm capable of being inserted into a ventilator.

FIG. 9 shows a diaphragm assembly for a ventilator, comprising a frame 90 in which a diaphragm 91 is held. Several cases may be anticipated. The diaphragm is made of an elastic material and the frame is rigid: the diaphragm is stretched during the installation thereof. The diaphragm is non-elastic and the frame is bent like an arc the diaphragm of which would be the chord. The diaphragm is non-elastic and the frame is rigid: the means of connecting 92 the diaphragm to the frame are elastic. In the case of a non-elastic diaphragm, the latter, which is flat when idle, for example, is inextensible in all or some of the directions of the plane thereof, but the diaphragm remains flexible in order to be capable of bending about an axis of this plane. Other embodiments are possible by combining the rigidities and elasticities of the means described in various other ways.

Figure 10:
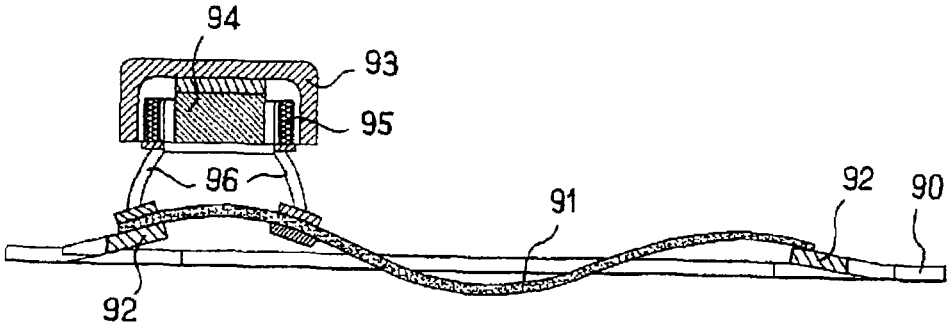
FIG. 10 is a diagram showing one possible motorization of a ventilator.

FIG. 10 is a schematic illustration of a reciprocating force couple generator, associated with a diaphragm 91 held by a frame 90. This generator comprises a stationary armature 93 (integral with a housing not shown, with which the frame 90 is also integral) inside of which a permanent magnet 94 is housed. A coil 95 is housed in the air gap between the armature and the magnet, so as to be capable of oscillating under the effects of an a.c. current travelling therethrough. This oscillation is transmitted to the diaphragm via arms 96, thereby forcing oscillation of the diaphragm at one of the ends thereof. This diaphragm is arranged between two end plates, as shown in the diagram of FIG. 8.

Figure 11:
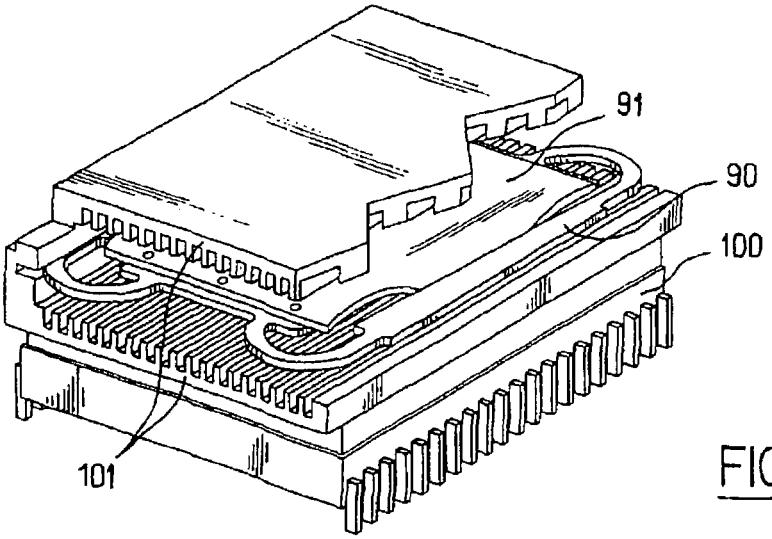
FIG. 11 shows the ventilating function implemented in accordance with the invention, as applied to the cooling of a set of electronic components.

One example of use of a ventilator according to the invention is shown in FIG. 11. This figure shows an electronic component 100 one of the faces of which provided in a known manner with a radiator for dissipating the heat produced during the operation thereof. According to the invention, this radiator is shaped like a tunnel with two end plates 101 and 102. This tunnel constitutes the body of a ventilator according to the invention, in which a diaphragm 91 is housed, like the one shown in FIG. 9, and which is motorized by a motor of the type shown in FIG. 10. The surfaces of the radiator facing the diaphragm will preferably be grooved in order to increase the transfer surfaces between the radiator and the air propelled by the circulator. It is understood that the entire air circulator body can fulfil this radiator function, an architecture which results in a very compact and especially ultra-flat ventilator.

Returning to FIG. 4B, the presence of an exciter 97, e.g., a piezoelectric or electromechanical vibrator, is noted beneath wall 26 of part 25 of the circulator body 20, which is capable of creating inside the circulator body a vibration of adjustable amplitude and opposite in phase to the reciprocating movement of the moving assembly consisting of the stirrup 43, the permanent magnet and the diaphragm 30. Owing to this vibration device, active sound insulation can be created, which enable the circulator to be rendered silent. This arrangement opens the field of applications of circulators to any field in which noise is an important factor. Mention is made most especially to household aquarium pumps.

Lastly, mention is made of an important field of application for the circulator according to the invention. This involves its use as a propeller unit. As a matter of fact, with regard to FIG. 8, it is understood, for example, that if the circulator body 80 is attached to the hull of any watercraft, the flow produced between the fluid inlet opening in the circulator and the discharge thereof through the exhaust opening 85, generates a reaction force on the hull which, if this fluid is a liquid, e.g., water, will propel the circulator body and therefore the body associated therewith in the opposite direction of the arrows shown in the figure. The circulator according to the invention can therefore constitute a means of propulsion for any watercraft, whether it is buoyant or submersible.

While the invention has been particularly shown and described with reference to the preferred embodiments thereof, it will be understood by those skilled in the art that various changes in form and details may be made without departing from the spirit and scope of the invention.

What is claimed is:

1. A fluid circulator, comprising:

a circulator body defining an internal circuit having at least one circulator inlet port, at least one circulator outlet port, and a plurality of propulsion chambers therebetween, each propulsion chamber of said plurality of propulsion chambers comprising a chamber inlet port and a chamber outlet port, said propulsion chambers of said plurality of propulsion chambers being connected in series;

the inlet port of a first propulsion chamber of said plurality of propulsion chambers forming the circulator inlet port and the outlet port of a second propulsion chamber of said plurality of propulsion chambers forming said circulator outlet port; and each propulsion chamber having rigid walls delimited by rigid surfaces;

the fluid circulator further comprising deformable diaphragms and in each propulsion chamber is placed one of the deformable diaphragms so that this deformable diaphragm extends between the rigid walls for facing the rigid surfaces of the propulsion chamber, each deformable diaphragm having a first edge forming an outer periphery of the diaphragm adjacent to the chamber inlet port of the chamber in which it is placed, a second edge adjacent to the chamber outlet port of the chamber in which it is placed, and a thickness that is progressively reduced from the first edge towards the second edge for increasing peak amplitude as amplitudes develop progressively from the first edge to the second edge;

the fluid circulator further comprising a reciprocating mechanical excitation device comprising a stirrup fixedly attached to the first edges of the diaphragms for imparting to the first edges of the diaphragms an alternative motion so that each of the diaphragms forms a support of a plurality of ripples generated by said alternative motion;

wherein, for each of said propulsion chambers, the rigid surfaces of the chamber extend between two envelope surfaces delimiting an amplitude of a free ripple of the diaphragm which is placed in the chamber would assume in absence of said rigid walls, so as to constrain said plurality of ripples of said diaphragm; and wherein, each of said diaphragms has at least one of its first and second edges associated with tension means for imparting some tension into this diaphragm at least when it ripples, the tension imparted into this diaphragm by the tension means being higher close to the corresponding chamber outlet port than close to the chamber inlet port of the chamber in which this diaphragm is placed.

2. The circulator according to claim 1, wherein each diaphragm divides the propulsion chamber in which it is placed into a first portion and a second portion of chamber extending respectively between a side of the diaphragm and one of the rigid walls of the chamber; and wherein, for each of said propulsion chambers:

said first portion has a first portion inlet port and a first portion outlet port;

said second portion has a second portion inlet port and a second portion outlet port;

said first portion inlet port is fluidically connected to said chamber inlet port;

said second portion outlet port is fluidically connected to said chamber outlet port; and said first portion outlet port is fluidically connected to said second portion inlet port;

so that for each of said chambers, said first portion of the chamber and said second portion of the chamber are fluidically connected in series.

3. The circulator according to claim 2, wherein, for each of said propulsion chambers of said plurality of propulsion chambers, said first portion outlet port is fluidically connected to said second portion inlet port by way of an internal conduit extending inside said circulator body.

4. The circulator according to claim 2, wherein, for each of said propulsion chambers of said plurality of propulsion chambers, said first portion outlet port is fluidically connected to said second portion inlet port by way of an internal conduit extending inside said diaphragm.

5. The circulator of claim 1, wherein each of said diaphragms is disk-shaped and has an outer periphery, said reciprocating mechanical excitation device being connected to each of said outer peripheries of the diaphragms for imparting to each of said diaphragms an alternative linear motion thereto, said reciprocating mechanical excitation device having a movable portion which is guided along an axis (X) perpendicular to planes of said diaphragms by a center guide column integral with said circulator body.

6. The circulator according to claim 5, wherein said movable portion includes an annular permanent magnet which surrounds said center guide column and which forms a plunger that magnetically cooperates with a coil extending inside a stationary armature extending around said permanent magnet.

7. The circulator according to claim 5, wherein each of said tension means comprises a rigid ring tightly encircling said outer periphery of the diaphragm in which the tension means imparts some tension.

8. The circulator according to claim 5, wherein each of said tension means comprises a rigid crown attached to said outer periphery of the diaphragm in which it imparts some tension.

9. The circulator according to claim 5, wherein each of said tension means comprises a magnet magnetically cooperating with an armature attached to the diaphragm in which the tension means imparts some tension.

10. The circulator according to claim 5, wherein each of said diaphragms is non-elastic and wherein each of said tension means comprises elastic means connecting the diagram to a rigid frame.

11. A fluid circulator, comprising:

a circulator body defining an internal circuit having one circulator inlet port, one circulator outlet port, and at least one propulsion chamber therebetween, said at least one propulsion chamber comprising a chamber inlet port and a chamber outlet port;

said at least one propulsion chamber having rigid walls delimited by rigid surfaces;

the fluid circulator further comprising at least one deformable diaphragm placed in said at least one propulsion chamber so that said at least one deformable diaphragm extends between the rigid walls for facing the rigid surfaces of the propulsion chamber, said at least one deformable diaphragm being disk-shaped and having a first edge forming an outer periphery of the diaphragm adjacent to the chamber inlet port, a second edge adjacent to the chamber outlet port, and a thickness that is progressively reduced from the first edge towards the second edge for increasing peak amplitude as amplitudes develop progressively from the first edge to the second edge;

the fluid circulator further comprising a reciprocating mechanical excitation device connected to said first edge of said at least one diaphragm for imparting to said first edge of said at least one diaphragm an alternative linear motion so that said at least one diaphragm forms a support of a plurality of ripples generated by said alternative linear motion;

wherein said reciprocating mechanical excitation device includes a movable portion which is guided along an axis (X) perpendicular to a plane of said diaphragm by a center guide column integral with said circulator body; and said movable portion including an annular permanent magnet which surrounds said center guide column for sliding along said center guide column and which forms a plunger that magnetically cooperates with a coil extending inside a stationary armature, said coil being attached to the stationary armature and said coil extending around said permanent magnet of the movable portion.

12. The Fluid circulator according to claim 11, wherein said rigid surfaces of said at least one chamber extend between two envelope surfaces delimiting an amplitude of a free ripple of said at least one diaphragm placed in the chamber would assume in absence of said rigid walls, so as to constrain said plurality of ripples of said diaphragm; and wherein, said at least one diaphragm has at least one of its first and second edges associated with tension means for imparting some tension into this diaphragm at least when it ripples, the tension imparted into this diaphragm by the tension means being higher close to the chamber outlet port than close to the chamber inlet port.

13. A fluid circulator, comprising:

a circulator body defining an internal circuit having at least one circulator inlet port, at least one circulator outlet port, and a propulsion chamber therebetween, the propulsion chamber comprising a chamber inlet port and a chamber outlet port; and the propulsion chamber having rigid walls delimited by rigid surfaces;

the fluid circulator further comprising a deformable diaphragm placed inside the propulsion chamber so that the deformable diaphragm extends between the rigid walls for facing the rigid surfaces of the propulsion chamber, the deformable diaphragm having a first edge forming an outer periphery of the diaphragm adjacent to the chamber inlet port, and a second edge adjacent to the chamber outlet port, and a thickness that is progressively reduced from the first edge towards the second edge;

the fluid circulator further comprising a reciprocating mechanical excitation device fixedly attached to the first edge of the diaphragm for imparting to the first edge of the diaphragm an alternative motion so that the diaphragm forms a support of a plurality of ripples generated by said alternative motion;

wherein the rigid surfaces of the chamber extend between two envelope surfaces delimiting an amplitude of a free ripple of the diaphragm would assume in absence of said rigid walls, so as to constrain said plurality of ripples of the diaphragm while said plurality of ripples of the diaphragm has an amplitude which increases going from the first edge towards the second edge; and wherein, the diaphragm has at least one of its first and second edges associated with tension means for imparting some tension into the diaphragm at least when it ripples, the tension imparted into the diaphragm by the tension means being higher close to the chamber outlet port than close to the chamber inlet port.

* * * * *